United States Patent [19]

Tsai

[11] 4,397,518

[45] Aug. 9, 1983

[54] PUSH-TYPE WIRE TERMINATING APPARATUS

[76] Inventor: Jing-Hwang Tsai, 83 Chang-Shi St., Sec. 1, An-Nan District, Tainan, Taiwan

[21] Appl. No.: 218,189

[22] Filed: Dec. 19, 1980

[51] Int. Cl.[3] ..... H01R 13/06

[52] U.S. Cl. ..... 339/255 R

[58] Field of Search ..... 339/248 S, 249 R, 253, 339/254, 255 R, 255 A, 255 B; 5/451

[56] References Cited

U.S. PATENT DOCUMENTS 2,788,505 4/1957 Camzi ..... 339/255 A 3,260,988 7/1966 Dean et al. ..... 339/254 R

*Primary Examiner*—Joseph H. McGlynn

[57] ABSTRACT

A novel push-type wire terminating apparatus comprises an outer casing having a hollow section within, and a movable body loosely coupled with the outer casing in the hollow section. The outer casing has a recess in the hollow section corresponding to a protrusion of the movable body, and elastic means disposed therein for engaging the protrusion in position at one end so as to make the movable body be able to slide up and down in the hollow section. At least a pair of conductors are fixedly arranged in the hollow section at one end and loosely coupled with the movable body at another through a wire guide opening therein. When making wire termination, press down the movable body, insert the prepared wire end from a passage on top of the movable body and let it pass through a wire hole on the conductor until it reaches at the end. Releasing the pressure applied on the movable body, the wire ends will be firmly secured to the conductors thereat and the termination is completed accordingly.

11 Claims, 10 Drawing Figures

PUSH-TYPE WIRE TERMINATING APPARATUS

BACKGROUND OF THE INVENTION

1. Field of the Invention

The present invention relating to a unique wire terminating apparatus is characterized by requiring neither disassembly operation for wire connection nor any screws for wire securing except by pressing down a movable body, inserting the wire ends through wire passages thereof and releasing the pressure so as to complete the wire termination therein.

2. Description of the Prior Art

In making wire termination on the conventional electric plug, socket, adapter and lamp receptacle, it has been necessary to disassembly the housing structure first, then make the termination on the internal components thereof and finally reassemble the housing structure. Therefore, the complication of these three steps—disassembly, termination and reassembly—becomes the main defect. Moreover, the plug and socket, once disassembled, are like a divided article. The identification of coupling elements and terminating operation are, of course, easy to those who are skilled in this field but difficult to those who are not familiar with electrical work. As a result, mistakes such as wrong connections, short circuits and abnormal re-assembly of the components can cause dangerous accidents. The only way to avoid this potential hazard is to ask a skilled person to make the termination, a easy job to do but an inconvenience in troubling other people with this trifling problem. Efforts have been made to overcome the above defect on the conventional plug, socket and lamp receptacle but problems still exist.

SUMMARY OF THE INVENTION

The present invention provides a novel and improved wire terminating apparatus completely eliminating the defect of the conventional plug, socket and lamp receptacle.

The primary object of this invention is to provide a simple wire terminating apparatus by means of pushing, inserting and making connection instead of disassembly, soldering or screw-connecting and re-assembly operation.

Another object of this invention is to provide a safe and easy wire terminating apparatus for those who are not familiar with electrical work so that no accidents on wire termination will occure.

These and other objects and a fuller understanding of the invention described herein may be had by referring to the following description of the preferred embodiments and claims taken in conjunction with the accompanying drawings.

BRIEF DESCRIPTION OF THE PREFERRED EMBODIMENTS

FIG. 1 is a sectional perspective view of the invention.

FIG. 1—1 is a bottom view of the movable body of this invention.

FIG. 7-1 is a top view of this invention.

FIG. 7-2 is a bottom view of the lamp receptacle of this invention.

DETAILED DESCRIPTION OF THE PREFERRED EMBODIMENTS

Figure 1:
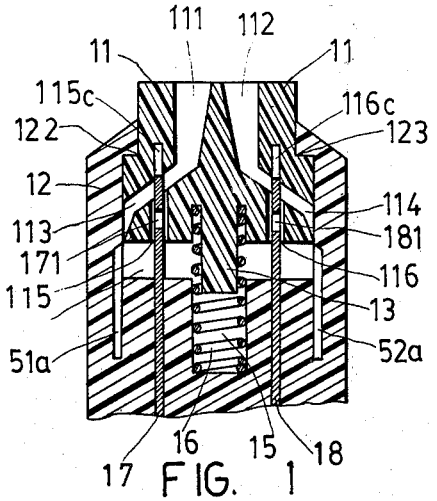
Figure 1:
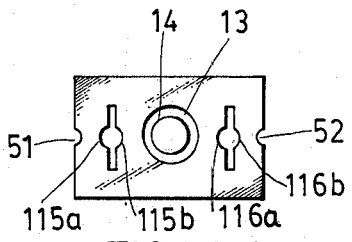

Referring to FIG. 1, the wire terminating apparatus of this invention includes an outer casing 12 having a hollow section therein and a movable body 11 located in the hollow section of the outer casing 12. On top of the movable body 11, at least one, preferably two passages 111 and 112, preferably of conical shape, are provided for wire insertion through the movable body 11. Curved sideward forming wire channels 113 and 114 communicate with passages 111 and 112 and further communicate with at least two wire grooves 51 and 52 provided on the outer surface of the movable body 11 for receiving wire ends extending from the wire channels 113 and 114 thereof when movable body 12 is moved to the position depicted in FIG. 2. On bottom of the movable body 11 a protrusion 13 having an annular groove 14 around its circumference is located at the center, and at least two guiding openings 115 and 116 for accommodating the relative movement of at least two metal conductors 17 and 18 at one end are provided between the side of the movable body 11 and the side of the protrusion 13. The guiding opening 115 and 116 having a plurality of arcuate sections **115*a*, 115*b*, 116*a*, and 116*b* (as shown in FIG. 1—1) at the lower portion for wire receiving and communicating with the wire channels 113 and 114 are elongated vertically into the upper portion of the movable body 11 so as to create certain clearances 115*c* and 116*c* therein with a depth equal to that of a space 121 between the bottom surface of the movable body 11 and the top surface of the hollow section of the outer casing 12 for allowing the up-and-down movement of the movable body 11**.

On top surface of the hollow section of the outer casing 12, a recess 15 corresponding to the protrusion 13 is situated in the center portion of the surface with elastic means such as a spring 16 being installed therein and engaged to the head annular groove of the protrusion 13 at one end so as to enable the movable body 11 to be operated up and down thereupon. Away from both sides of the recess 15, at least two metal conductors 17 and 18 having a wire through hole 171 and 181 at the upper portion and loosely protruding into the movable body 11 through the guiding opening 115 and 116 are respectively fixed at the lower portion preferably through molding with the outer casing 12.

Corresponding to the wire grooves 51 and 52 on the outer surface of the movable body 11, at least two wire grooves **51*a* and 52*a* are respectively located along the inner wall of the outer casing 12 for receiving the wire ends coming down from the wire grooves 51 and 52. Besides, at least two positioning lugs 122 and 123 are provided at the top portion of the outer casing 12 so as to keep the movable body 11 in position and further to prevent it from being ejected out of the outer casing 12 by the elastic force of the spring 16**.

Figure 2:
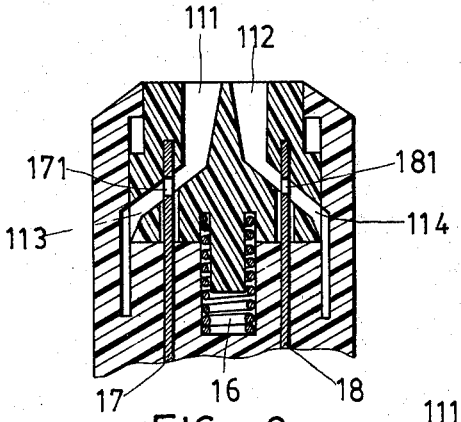
FIG. 2 is a sectional and perspective view of this invention when the movable body is pushed down therein.
Figure 3:
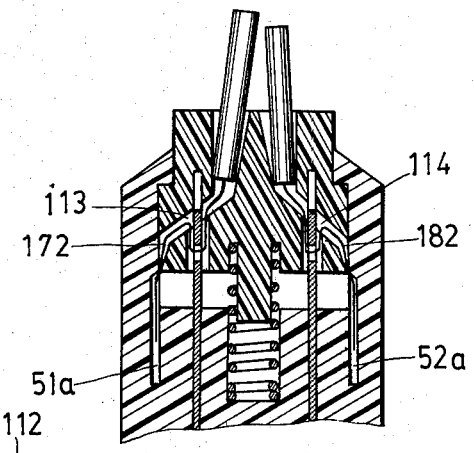
FIG. 3 is a sectional perspective view of the invention after completion of wire termination.

Concerning the terminating procedure, just press down the movable body 11, as shown in FIG. 2, to ensure that the bottom surface of the movable body 11 is in contact with the top surface of the hollow section of the outer casing 12 so that the wire through holes 171 and 181 of the metal conductors 17 and 18 will be in line with the wire channels 113 and 114. Insert the prepared wire ends 172 and 182 separately through the passages 111 and 112 on top of the movable body 11 and permit the wire ends 172 and 182 moving down the wire channels 113 and 114 pass through the wire through-hole 171 and 182 and reach the wire grooves 51*a* and 52*a*. Then release the pressure applied on top of the movable body 11, the wire ends separately inserted therein being pulled down and pressed into the wire receiving arc sections 115*a*, 115*b*, 116*a* and 116*b* respectively by the metal conductors 17 and 18 through the upward elastic force of the spring 16. Thus the termination is completed as is shown in FIG. 3.

Figure 4:
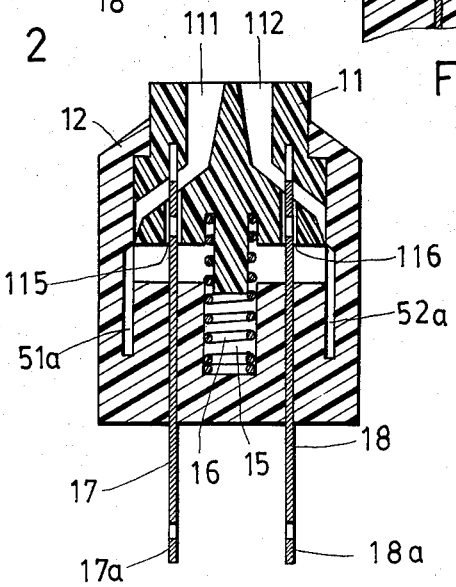
FIG. 4 is a sectional perspective view of this invention adapted to a plug.

More embodiments of this invention as being adapted to plug, socket, line adapter, lamp receptacle etc. are illustrated as follows:

Shown in FIG. 4 is a sectional view of this invention adapted to a plug. All the elements and structure are the same as those described in the first embodiment shown in FIG. 1 except that the lower portion of the metal conductors 17 and 18 are extended out of the bottom surface of the outer casing 12 for being served as plug prongs 17*a* and 18*a*.

Figure 5:
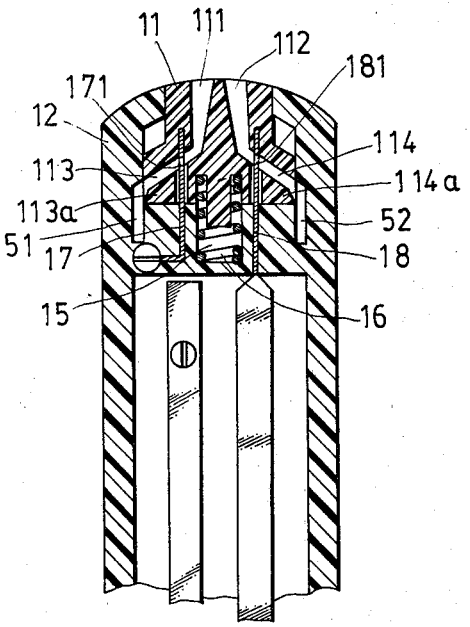
FIG. 5 is a sectional perspective view of this invention adapted to a socket.

Shown in FIG. 5 is a sectional view of this invention adapted to a socket of which the outer casing 12 having a socket portion at its lower section is constructed as a single unit, and the lower end of the conductors 17 and 18 are connected respectively to the conductor of the female elements in the socket portion. In addition, the lower edge of the wire channel 113 and 114 is chamfered separately to form a slope 113*a* and 114*a* so as to enable the wire ends extending from the wire through hole 171 and 181 to be firmly held in position against the inner wall of the outer casing 12 through the slope 113*a* and 114*a* when the pressure applied on the movable body 11 is removed therefrom. The remaining terminating procedure is the same as that described in the first embodiment shown in FIG. 3.

Figure 6:
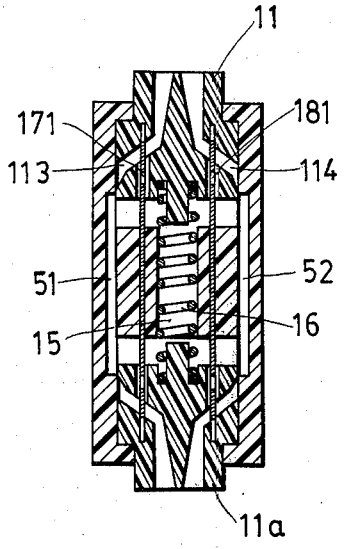
FIG. 6 is a sectional view of this invention adapted to a line adapter.

Shown in FIG. 6 is a sectional view of this invention adapted to a line adapter which, in fact, is a combination of the apparatus described in the first embodiment except that two movable bodies 11 and 11*a* share the same spring 16.

Figure 7:
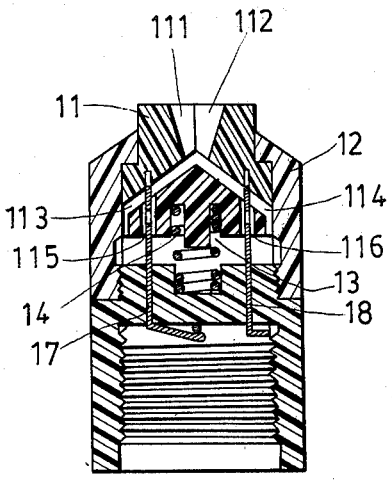
FIG. 7 is a sectional and perspective view of this invention adapted to a lamp receptacle.
Figures 1, 7:
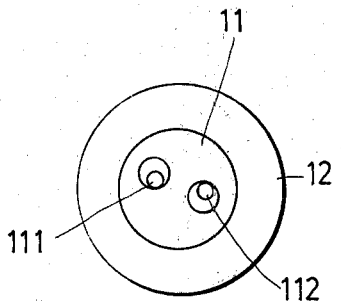
Figures 2, 7:
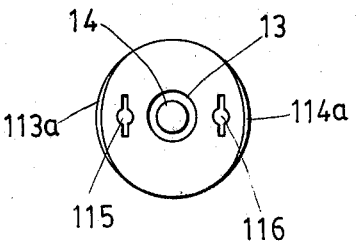

Shown in FIG. 7 is a sectional view of this invention adapted to a lamp receptacle which is designed in a cylindrical shape as a preferred embodiment. This lamp receptacle is substantially the same apparatus described in the first embodiment except that the outer casing 12 is divided into two portions of which the upper portion 12 is loosely coupled with the movable body 11 while the lower portion having fixed metal conductors is screw-connected with the upper portion serving as a lamp base thereat.

Referring to FIG. 7–1, the passages 111 and 112 for wire insertion are 180° opposite with each other in diagonal direction. Referring to FIG. 7–2, the lower portion of the wire channel 113 and 114 is in elliptical shape so as to leave a certain space 113*a* and 114*a* between the outer surface of the movable body 11 and the inner wall of the outer casing 12. The purpose of said space 113*a* and 114*a* is to provide a wide area for accommodating the free ends of wire terminals thereof because the screw-connected outer casing 12 needs more area to align the space 113*a* and 114*a* with the wire channel 113 and 114 thereof.

While preferred embodiments have been illustrated and described, it will be apparent that many changes may be made in the general construction and arrangement of the invention without departing from the spirit thereof, and it is therefore desired that the invention be not limited to the exact disclosure but only to the extent of the appending claims.

I claim:

1. A wire terminating apparatus comprising:

an outer casing having a hollow section therein and at least one metal conductor fixed in the hollow section, one end of the metal conductor protruding out of said outer casing, said metal conductor also having a guide opening;

a movable body provided within the hollow section and having at least one passage therein for receiving a wire, and a wire channel therein in communication with the passage to allow a wire inserted therethrough to contact with the metal conductor in said guide opening;

elastic means installed within the hollow section of said outer casing and contacting said movable body; and wherein both the outer side of said movable body and the inner wall of said outer casing are provided with wire grooves corresponding to each other and in communication with said wire channel for receiving the free wire ends therein.

2. A wire terminating apparatus as claimed in claim 1 wherein the metal conductor has a wire through hole at the upper part for wire passing and securing in position therein.

3. A wire terminating apparatus as claimed in claim 1 wherein the outer casing has a positioning lug on the inner wall of the top portion for keeping the movable body in position.

4. A wire terminating apparatus as claimed in claim 1 wherein the lower portion of the hollow section is preferably provided with a recess for positioning said elastic means.

5. A wire terminating apparatus as claimed in claim 4 wherein the underside of said movable body is provided with a protrusion for connecting with the upper portion of said elastic means.

6. A wire terminating apparatus as claimed in claim 1 wherein a guide opening is provided intersecting said wire channel for accommodating said conductor, the upper portion of said guide opening having a predetermined clearance for the up-and-down movement of said movable body along with said conductor and the lower portion of said guide opening having a plurality of arc sections for wire receiving and securing together with said conductor therein.

7. A wire terminating apparatus as claimed in claim 6 wherein a predetermined space between the underside of said movable body and the top surface of said hollow section is formed with a space distance equal to that of said clearance at the upper portion of said guide opening so that when pressing down said movable body in contact with the top surface of said hollow section, said wire through hole of said conductor is in exact line with said wire channel for facilitating wire insertion operation.

8. A wire terminating apparatus comprising:

an outer casing having wire grooves separately formed therein, a recess integrally provided in a middle portion thereof, a hollow section formed in an upper portion thereof and a plurality of positioning lugs integrally shaped on an inner wall of the upper portion;

a plurality of metal conductors fixed in said outer casing, the lower ends of said conductors extending out of a lower surface of said outer casing for making electrical contact and the upper ends each having a wire through hole formed therein located in said hollow section of said outer casing;

a movable body having a plurality of wire openings formed in the upper end portion thereof for receiving the ends of the wire to be terminated by the apparatus, said openings communicating with a plurality of wire channels which, in turn, intersect both the outer wall of said movable body and a plurality of guide openings axially formed therein, the upper ends of said metal conductors being loosely received in said guide openings, and a protrusion integrally provided on the middle of the lower end which is sized to be loosely received in said recess of said outer casing; and an elastic means installed in said recess of said outer casing at one end and engaged with said protrusion of said movable body at another so that, by the tension of said elastic means, said movable body abuts against said positioning lugs within said hollow section of said outer casing, and said movable body be depressable against the tension of said elastic means to permit the wire ends to be inserted through said wire channels and wire through holes thereof, and releasable for securing the wire ends to said metal conductors in said guide openings.

9. The wire terminating apparatus as claimed in claim 8 wherein said guide openings of said movable body are characterized by having a predetermined clearance available in the upper portion when said upper ends of said metal conductors are received therein so as to permit the relative upward movement of said upper ends of said metal conductors along with the downward movement of said movable body, and an arc section integrally formed in the lower portion for receiving and securing the wire ends therein together with said upper ends of said metal conductors.

10. The wire terminating apparatus as claimed in claim 8 wherein said movable body disposed within said hollow section of said outer casing is characterized in that there exists a predetermined clearance between an underside of said movable body and an inner top surface of said hollow section, said wire guide openings, having a wire guide clearance above said metal conductors for receiving said metal conductors when said movable body is depressed, said wire guide clearance being at least as large as said predetermined clearance, and wherein said wire through holes in said upper ends of said metal conductors align with said wire channels when said movable body is depressed.

11. A wire terminating apparatus comprising: a member having at least one opening formed therein for receiving at least one wire to be terminated, at least one wire channel in communication with each of said at least one opening and at least one guide opening axially formed in said member and intersecting each said wire channel;

at least one conductor movably disposed in each said guide, each said conductor having an opening therein adjacent an end thereof, said conductor opening aligning with said wire channel in a first given position of said conductor relative to said member; and elastic means for urging said conductor from said first given position to a second given position whereat said conductor opening no longer aligns with said wire channel;

each said guide opening being sized to receive both the conductor disposed therein and a portion of the wire when routed through the opening in the conductor disposed therein and when said conductor is in said second given position.

* * * * *